United States Patent [19]

Reeves

[11] Patent Number: 4,962,871

[45] Date of Patent: Oct. 16, 1990

[54] APPLICATOR UTILIZING HIGH SPEED NON-CONTACT EXTRUSION VALVE

[75] Inventor: Michael A. Reeves, Cincinnati, Ohio

[73] Assignee: Valco Cincinnati, Inc., Cincinnati, Ohio

[21] Appl. No.: 383,334

[22] Filed: Jul. 24, 1989

[51] Int. Cl.[5] ..... B67D 3/00

[52] U.S. Cl. ..... 222/504; 222/518; 251/129.21; 335/219; 335/281; 335/297

[58] Field of Search ..... 222/504, 518, 559, 146.5; 335/219, 279, 281, 297; 251/129.15, 129.21

[56] References Cited

U.S. PATENT DOCUMENTS

| | | | |
|---|---|---|---|
| 3,212,715 | 10/1965 | Cocks . | |
| 3,408,008 | 10/1968 | Cocks . | |
| 3,485,417 | 12/1969 | Cocks . | |
| 3,662,927 | 5/1972 | Cocks . | |
| 3,741,441 | 6/1973 | Eberle | 222/504 X |
| 3,811,601 | 5/1974 | Reighard et al. | 222/146.5 X |
| 4,215,802 | 8/1980 | Ornsteen | 222/504 X |
| 4,465,212 | 8/1984 | Boone | 222/504 |
| 4,488,665 | 12/1984 | Cocks et al. . | |
| 4,524,887 | 6/1985 | Cocks . | |
| 4,530,862 | 7/1985 | Kerzel . | |
| 4,711,379 | 12/1987 | Price | 222/146.5 X |
| 4,795,060 | 1/1989 | Albrecht | 222/504 X |

*Primary Examiner*—Andres Kashnikow
*Assistant Examiner*—Gregory L. Huson
*Attorney, Agent, or Firm*—Frost & Jacobs

[57] ABSTRACT

An airless, solenoid-operated applicator having a high speed non-contact extrusion valve, wherein the time required for opening and closing the plunger assembly of the valve, as well as for the applicator to recycle, is minimized by concentrating an electromagnetic field on pole pieces made of magnetically soft material. The electromagnetic field is generated by a coil having windings with a length substantially equal to the distance between their inner and outer diameter. Further, the dynamic pole has a length relative to the length of the windings since the plunger assembly is spring-loaded within the static pole instead of the dynamic pole. An annealing process may also be performed on the pole pieces, as well as various magnetically conductive and corrosion resistant coatings or platings applied thereto, in order to further enhance the susceptibility of the pole pieces to magnetism.

26 Claims, 6 Drawing Sheets

APPLICATOR UTILIZING HIGH SPEED NON-CONTACT EXTRUSION VALVE

BACKGROUND OF THE INVENTION

1. Field of The Invention

This invention relates in general to the field of applicators and in particular to an applicator having a high speed non-contact extrusion valve for use in automated assembly line operations.

2. Description of The Prior Art

Where a fluid is applied or supplied to various products, including but not limited to adhesive for paper cartons, paper towels, envelopes, labels, or other like products, it is typical that applicators be used to apply the fluid. In adhesive applications, the adhesive may be in the form of small dots, thin dashed or solid lines, large dots or broad dashed or solid lines. The lines or dots are usually applied in a direction coincident with the direction of travel of the product as it travels past the fixed position of the applicator.

As noted in the background section of U.S. Pat. No. 4,488,665 to Cocks, et al., adhesive applicators first utilized in the prior art were air actuated, whereby a built-in air cylinder was used to lift a shutoff needle from a seat to permit the dispensing of a pressurized adhesive. Air-operated actuators have been found to be inherent limitations in applying adhesives in high speed assembly line applications. For example, they are not sufficiently responsive for high-speed production, where their use results in misapplication of the amount of the adhesive and mislocation of the placement of the adhesive. If the adhesive is misplaced or applied at the wrong location, the product may be spoiled and perhaps be rejected as unsatisfactory. Similarly, if insufficient adhesive is applied, the glued joint may be weaker or stronger than required. Then, if an attempt is made to overcome an insufficiency of adhesive by applying additional adhesive at additional locations where such additional locations are not critical to the product, the cost of such additional adhesive may unnecessarily and materially add to the costs of production. Thus, for every application there is an optimum condition of applying the exact amount of adhesive at the desired location at the fastest possible production speed. For such adhesive applications, applicators are required which dispense the adhesive and respond accurately and repeatedly to input control signals.

Attempts have been made to overcome the inherent disadvantages in high speed air-operated applicators by the use of sophisticated electronic equipment to operate the solenoid valves for purposes of controlling the air used to operate the applicator; however, such attempts have not in general been totally satisfactory. In high speed applications, electronic control of the air still resulted in an excessive time delay between the operation of the valve and the subsequent operation of the air cylinder in the applicator. This time delay was not consistent and varied inasmuch as sealing packings within the valve changed characteristics with heat and use, causing inconsistencies in application of the adhesive when responding to the same signal.

The use of airless, solenoid-operated adhesive spray applicators have overcome some of the above-noted problems of the air-operated applicators. In such applicators, the adhesive is applied without the use of compressed air. Upon activation, a solenoid unseats a spring-loaded plunger which then permits a pressurized adhesive to flow through the valve and onto the product. One example of an airless, solenoid-operated valve of this type is disclosed in U.S. Pat. No. 3,212,715 to Cocks. In fact, the basics of the Cocks '715 patent are also utilized in the Cocks, et al. '665 patent relating to a multiple-outlet adhesive applicator.

Although airless, solenoid-operated applicators are known in the prior art, high speed assembly line operations generally have been limited by the performance characteristics thereof. In particular, the time required for the valve in an applicator to open and close, as well as the time required by the applicator before the valve can repeat this cycle, are functional requirements which manufacturers in the industry are continually attempting to improve upon. Principally, this is because the less time taken to open and close the valve (i.e., the faster the valve opens and closes), the greater the ability to perform shorter and more precise adhesive patterns, which translates into use of less glue during an operation (and less cost). Most importantly, however, shortening the time for opening and closing the valve, as well as reducing the time required before the applicator is ready to repeat the cycle, enables a conveyor carrying the product to be run at a faster speed and/or the product to be placed closer together on the conveyor, each of which increases production.

Accordingly, a primary object of the present invention is to provide an applicator having a non-contact extrusion valve which requires a minimum time for opening and closing.

Another object of the present invention is to provide an applicator which requires a minimum amount of time before recycling.

Still another object of the present invention is to provide an applicator having a coil which generates a maximum electromagnetic field and pole pieces which have maximum susceptibility to the electromagnetic field.

Yet another object of the present invention is to provide an applicator having a solenoid coil which minimizes the time required to generate and collapse an electromagnetic field.

SUMMARY OF THE INVENTION

As will be explained in more detail hereinafter, the present invention drastically improves the response time for opening and closing the valve by maximizing the electromagnetic field generated by its coil and the susceptibility of the pole pieces. Moreover, the time required for the coil to generate and collapse an electromagnetic field is minimized, which reduces the time required by the applicator before recycling. In a preferred embodiment of the present invention, the applicator comprises a high speed non-contact extrusion valve including a solenoid coil. After current is supplied to the coil, an electromagnetic field is generated which is concentrated on the valve's static and dynamic poles. This electromagnetic field causes the valve's spring-loaded plunger assembly to overcome the spring force and move toward the static pole, which in turn opens the seat of the valve and allows fluid flow. Once current to the coil is discontinued, the plunger assembly moves back away from the static pole in accordance with the spring force to close the seat, whereby fluid flow is then discontinued.

In order to minimize the time required to open and close the valve, the spring is positioned inside the static pole, which allows reduction in the size of the dynamic pole and correspondingly the mass of the plunger assembly to be moved. Grooves are cut into the top and sides of the dynamic pole which provide a path for fluid flow. The top grooves also increase the surface area of the dynamic pole subject to the electromagnetic field.

Further, the length of the coil is kept as short as possible since the area in which the electromagnetic field must be applied is smaller, thereby reducing the time required for generating and collapsing the electromagnetic field which in turn allows the applicator to recycle more quickly. The coil is also iron clad in order to redirect the external electromagnetic field generated by the coil toward the pole pieces.

Further, the pole pieces are made of a magnetically soft material to enhance their susceptibility to the electromagnetic field. In order to counteract the corrosive nature of such material, the static and dynamic poles are coated or Plated with material which is both magnetically conductive and corrosion resistant. An annealing process may also be performed on the pole pieces to align the grain structure thereof, which enhances magnetic conductivity and eliminates impurities.

A controller is utilized to signal the applicator when to dispense fluid and is able to compensate for the time lag between application (or discontinuance) of current to the coil and opening (or closing) of the valve.

BRIEF DESCRIPTION OF THE DRAWING

While the specification concludes with claims particularly pointing out and distinctly claiming the present invention, it is believed the same will be better understood from the following description taken in conjunction with the accompanying drawing in which:

DESCRIPTION OF THE PREFERRED EMBODIMENTS

Figure 1:
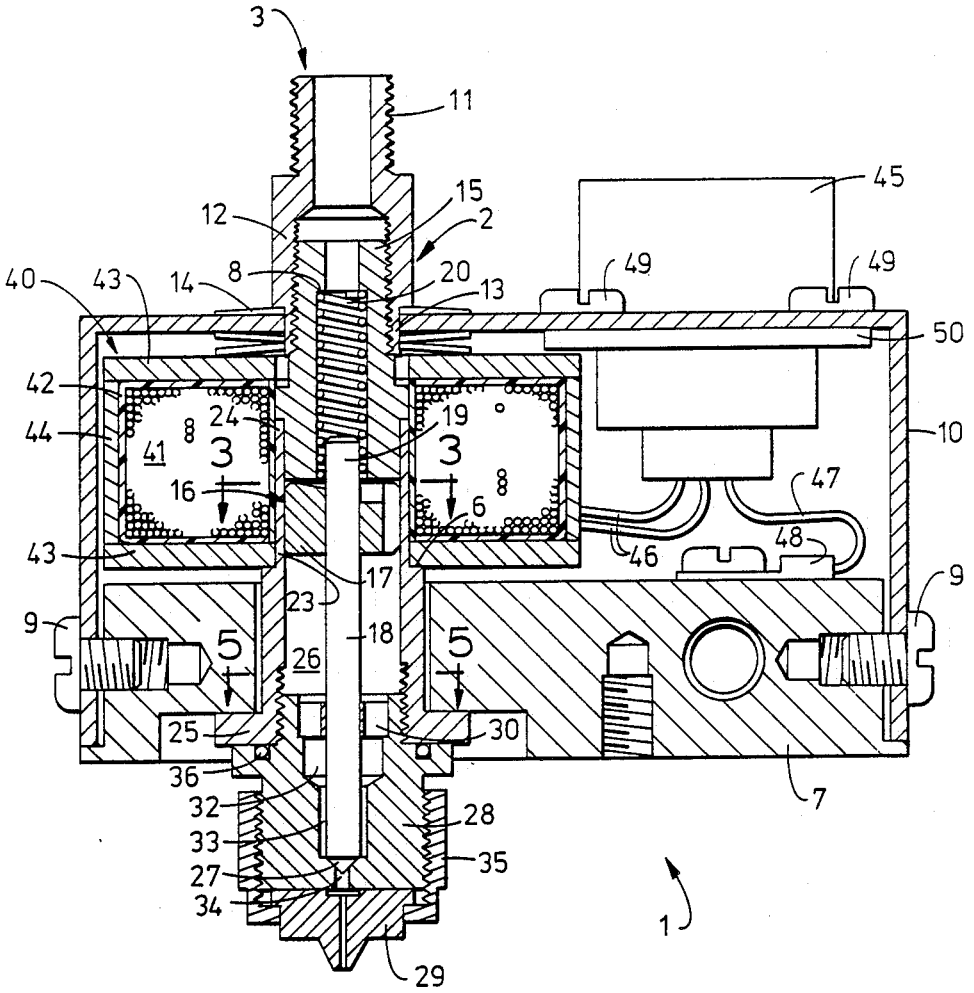
FIG. 1 is a partially cross-sectional side view of an applicator made in accordance with the present invention.

As will be explained in more detail hereinafter, the solenoid actuated applicator of the present invention maximizes the electromagnetic field generated by the solenoid coil, as well as the susceptibility of the dynamic and static poles in the non-contact extrusion valve to that electromagnetic field, whereby the response time for the valve's plunger assembly to move from a closed position to an open position (and vice-versa) is minimized. Moreover, the design of the present invention minimizes the time required by the applicator for recycling.

The present invention, while generally disclosing an airless, solenoid-operated applicator for use with high viscosity fluids, can be used for applying adhesives and is therefore described in the preferred embodiment with respect to such function. Applicator 1 is comprised generally of a non-contact extrusion valve 2, including a fluid body assembly 3 and a solenoid coil 40, as well as a conventional means (not shown) for supplying current to coil 40. More specifically, applicator 1 comprises a housing base 7, which is configured to retain valve 2. A five-sided housing cover 10 is attached to housing base 7 of applicator 1, such as by screws 9, in order to protect the internal components thereof from the environment.

Figure 2:
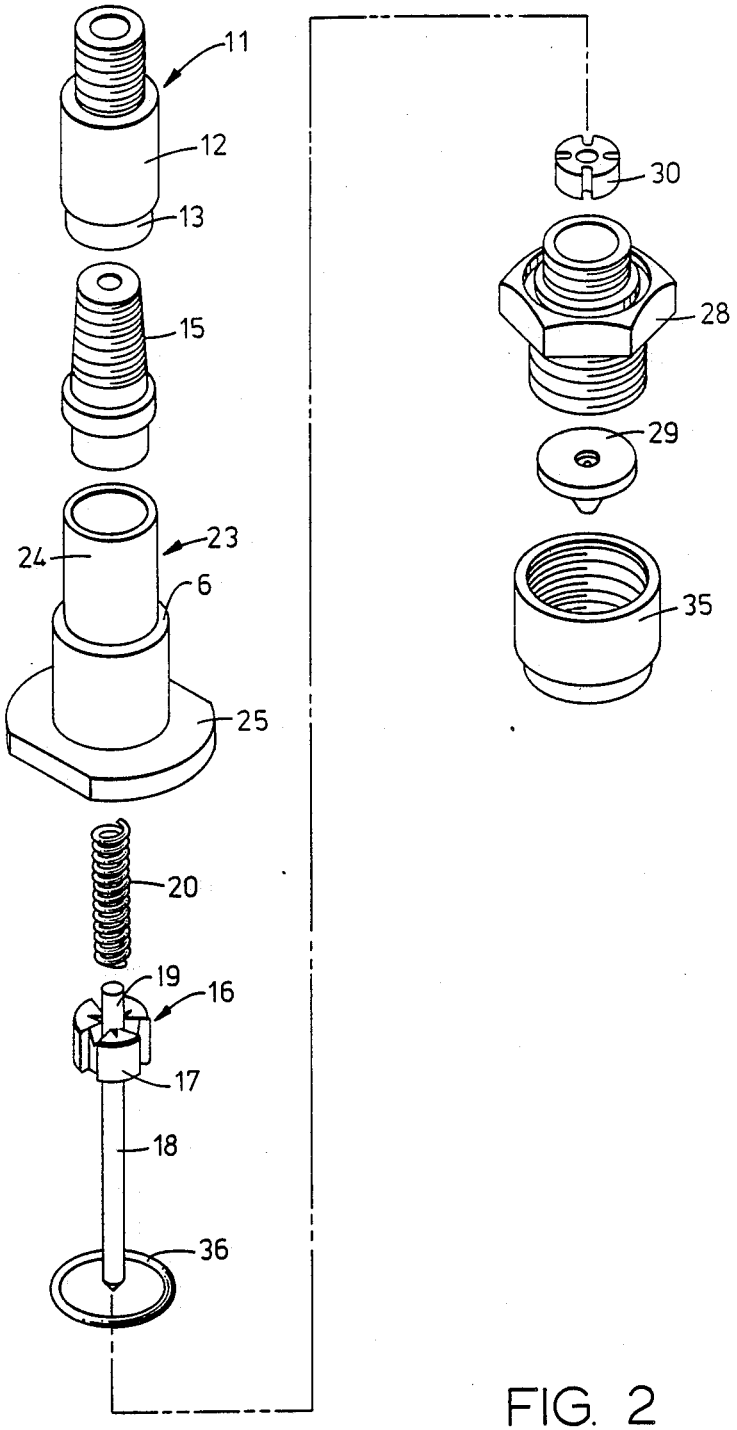
FIG. 2 is an exploded view of the fluid body assembly in the applicator of FIG. 1.

As seen in FIG. 2, a generally cylindrical male/-female pipe adapter 11 is utilized as an inlet to fluid body assembly 3, a hose or other metal fitting (not shown) being threadably connected thereto so that a pressurized supply of adhesive (or other fluid) may be provided. A longitudinal hole is provided through the middle of pipe adapter 11 for fluid flow, the hole being uniform in diameter until pipe adapter 11 expands in diameter at a middle portion 12 (whereafter the hole likewise expands). Pipe adapter 11 then is reduced in diameter at lower portion 13, the bottom edge of middle portion 12 being adjacent to housing cover 10 and cushioned by a spring washer 14, as lower portion 13 of pipe adapter 11 is fitted in a hole in housing cover 10.

A generally cylindrical static pole 15 is threadably received by the lower and middle portions 13 and 12 of pipe adapter 11. A longitudinal hole is provided through static pole 15, but the upper edge of static pole 15 causes a reduction in the flow path diameter of the hole running longitudinally through pipe adapter 11. The upper end of a plunger assembly 16 is positioned adjacent the lowermost end of static pole 15. Plunger assembly 16 is further comprised of a dynamic pole 17 and a needle 18 which extends through dynamic pole 17 such that a top portion 19 of needle 18 partially extends into the hole in static pole 15. A compression spring 20 is positioned within the hole in static pole 15 and braced at one end by annular flange 8. Spring 20 rests at the opposite end upon dynamic pole 17 around top portion 19 of needle 18, such that the force of spring 20 biases plunger assembly 16 away from static pole 15 a slight distance (approximately 10–15 thousandths of an inch).

Figure 3:
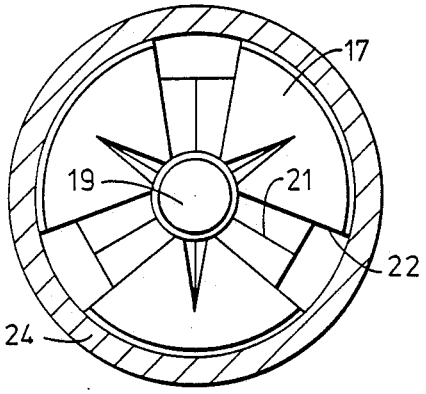
FIG. 3 is a cross-sectional view taken along section line 3—3 of FIG. 1 showing the top of the plunger assembly.
Figure 4:
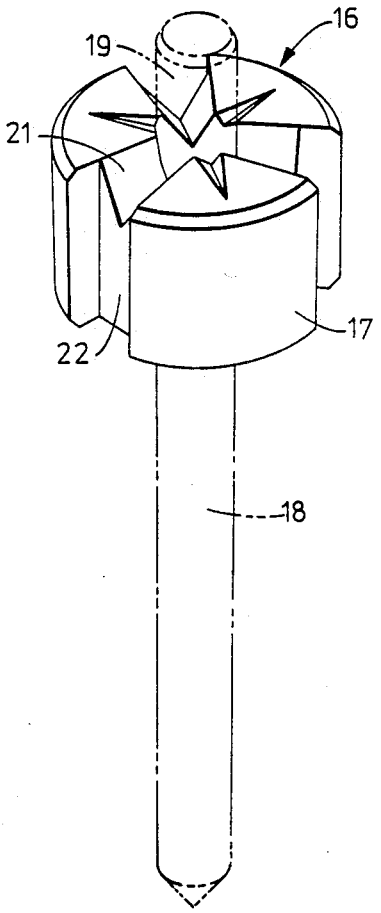
FIG. 4 is a partially diagrammatic perspective view of the Plunger assembly utilized in the fluid body assembly of the valve depicted in FIG. 2.

The top of dynamic pole 17, as best seen in FIGS. 3 and 4, has three V-shaped grooves 21 cut therein, although other shapes or numbers of grooves may be utilized. Longitudinal side grooves 22 then extend from the edge of V-shaped grooves 21 down the side of dynamic pole 17. Accordingly, adhesive is allowed to flow through the hole in static pole 15 (and spring 20) to the top of dynamic pole 17. Thereafter, the adhesive flows horizontally through V-shaped grooves 21 and down longitudinal side grooves 22 in dynamic Pole 17. It should be noted that top 19 of needle 18 serves to encourage lateral flow of the adhesive across the top of dynamic Pole 17 and out of V-shaped grooves 21.

A generally cylindrical fluid body 23 is also provided in fluid body assembly 3, whereby the lower portion of static pole 15 is frictionally fit and welded into the upper portion 24 thereof. Fluid body 23 further serves to form a chamber 26 in which plunger assembly 16 is slidably retained.

Figure 5:
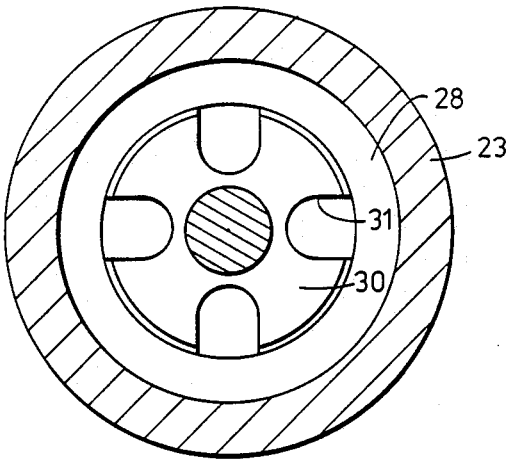
FIG. 5 is a cross-sectional view taken along section line 5—5 of FIG. 1 showing the top of the needle guide bushing.

Needle 18 fits into a nozzle seat adapter 28 positioned adjacent lower flange portion 25 of fluid body 23, an O-ring 36 being positioned between nozzle seat adapter 28 and fluid body 23 in order to provide a seal against leakage. As specifically seen in FIG. 1, a needle guide bushing 30 is provided below chamber 26 in order to stabilize needle 18. Besides including a hole for needle 18 to extend therethrough, individual slots 31 (as best seen in FIG. 5) are provided in the respective quadrants of needle guide bushing 30 to allow adhesive to flow from chamber 26 to an intermediate chamber 32 in needle seat adapter 28. After the adhesive flows through intermediate chamber 32, it flows through a tubular area 33 and finally to seat 34. In order to improve the accuracy of and define the adhesive application, an outlet nozzle 29 is positioned adjacent seat 34 and held in such position by retaining nut 35.

Needle 18 is aligned in needle seat adapter 28 such that a tapered end portion 27 can be caused to restrict adhesive flow through seat 34. Initially, flow is restricted due to the bias of spring 20 against plunger assembly 16, thereby causing tapered end portion 27 to abut seat 34. In order to allow flow of the adhesive through seat 34, plunger assembly 16 must slide in fluid body 23 toward static pole 15. This is accomplished through the resultant magnetic forces between dynamic pole 17 and static pole 15, as well as application of a concentrated electromagnetic field on static pole 15 and dynamic pole 17. This concentrated electromagnetic field is provided by coil 40.

Coil 40 is made up of windings 41, which are encased initially by a potting layer 42 and thereafter by flux washers 43 at the top and bottom and flux ring 44 around the side. This construction of flux washers 43 and flux ring 44 is known in the art as an iron clad solenoid. Coil 40 rests on a shoulder 6 of fluid body 23 and is cushioned against housing cover 10 by means of spring washer 14. Coil 40 generates an electromagnetic field, as is well known in the art, when current is supplied thereto. A connector 45 is provided, along with wires 46 to coil 40, for this purpose. A wire 47 is also connected between connector 45 and terminal 48 as a ground to protect against electrical shock. Connector 45 is attached to housing cover 10 by screws 49 in gasket 50. It is well known by those skilled in the art that a voltage source (either DC or AC) may be connected to connector 45 in order to provide current to coil 40.

One of the advantages of the present invention is the utilization of a coil which is able to generate and collapse an electromagnetic field quickly. This is accomplished by configuring windings 41 of coil 40 so that their length is equal to the distance from the windings' inner diameter to their outer diameter (as seen on both sides of fluid body 23 in FIG. 1). The impedance of coil 40 may also be reduced, preferably to 5–10 ohms. Normally, coils utilized in the prior art for airless, solenoid-operated applicators have windings with a length (and impedance) much greater than in the present invention (at least 2–3 times the distance from the inner diameter to the outer diameter of the windings), which is particularly disadvantageous due to the time required for generating and collapsing an electromagnetic field and because of the significant impedance of the windings. In particular, use of such coils in the prior art prevent an applicator from recycling as fast as in the present invention.

As noted previously, an iron clad solenoid made up of flux washers 43 and flux ring 44 is used to redirect the external electromagnetic field generated by windings 41 so that it is more concentrated on static and dynamic poles 15 and 17. By reducing the length of windings 41 in coil 40, as compared to the prior art, the electromagnetic field generated thereby is thus able to be concentrated in a much smaller area. This is particularly important where, as here, the distance to be traveled by plunger assembly 16 is very short and the speed in which plunger assembly 16 moves to open or close valve 2 is all important.

Correspondingly, the length of dynamic pole 17 may be reduced in size, preferably to one-half the length of windings 41 in coil 40. This reduction in size for dynamic pole 17 has several consequences. First, any reduction in mass of dynamic pole 17 results in a reduction in the electromagnetic force required for plunger assembly to overcome the force provided by spring 20. Again, this is critical considering plunger assembly 16 need move only a very short distance (approximately 10–15 thousandths of an inch in a typical application). Further, dynamic pole 17 is able to fit entirely within the concentrated electromagnetic field generated by windings 41 of coil 40, which is a more efficient use of the field. Dynamic pole 17 may also be reduced in size compared to the prior art because spring 20 is placed within static pole 15 rather than a hole formed within dynamic pole 17 as is done in other prior art applications. Therefore, no additional length is needed for dynamic pole 17 to accommodate a spring therein.

In addition to maximizing the electromagnetic field generated by coil 40 and minimizing the force required to overcome the bias or force of spring 20, the present invention enhances the susceptibility of static and dynamic poles 15 and 17 to the electromagnetic field by utilizing magnetically soft material therefor. While it is generally recognized that use of magnetically soft material, such as a low carbon steel (e.g., C1018 C.F.S.), is more conducive to receiving and disposing of an electromagnetic field (since it has a greater flux density and permeability, along with a lower resistivity to magnetic flux passing therethrough), it is not utilized in Prior art applicators due to its corrosive nature. Obviously, due to the hydraulic flow of fluids through valve 2, corrosion is of great concern. In order to combat the corrosive tendencies of the magnetically soft material utilized for static pole 15 and dynamic pole 17 in the present invention, they each are coated or plated with material which is both magnetically conductive and corrosion resistant. For example, the pole pieces may be coated with titanium nitrate through an ionized atomization process, copper plated, or coated with melanite by means of a salt bath nitrating process.

Further, even before applying such coatings or plating, pole pieces 15 and 17 can be subjected to an annealing process. This consists of heating the magnetically soft material in order to align the grain structure thereof. By doing so, this not only enhances the ability of the pole pieces to conduct magnetism generated by windings 41 of coil 40, but eliminates impurities (including carbon) which are not magnetically conductive.

In conjunction with the applicator of the present invention, a controller (not shown) may be utilized to provide appropriate signals to the applicator for dispensing the adhesive in correlation to the speed of the product passing thereunder. This type of controller is well known in the art, and essentially compensates for a lag in time between when the applicator must be signaled and when the applicator actually begins or ends dispensation of the adhesive. An encoder may also be provided to measure the speed of the product passing under the applicator. A constant signal can then be sent from the encoder to the controller so that changes in the speed of the product traveling under the applicator may be automatically taken into account.

Figure 6:
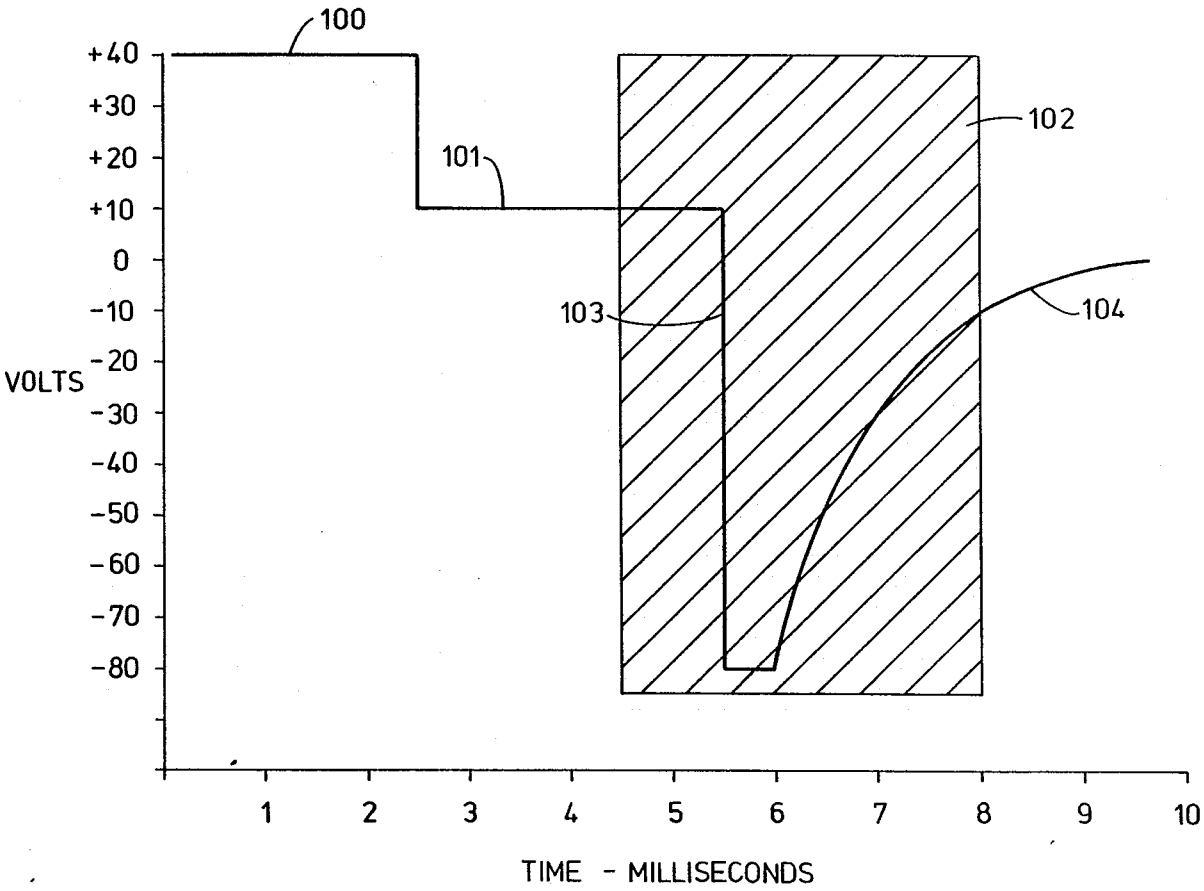
FIG. 6 is a graph depicting the signals sent to and response times of the applicator in FIG. 1 during a typical cycle.

As seen in FIG. 6, a graph is provided which depicts the typical signals provided to applicator 1 (volts versus time in milliseconds) by means of a controller to connector 45 and thereafter to coil 40. In this graph, a representative high viscous fluid of 750 centipoise is used at a pressure of 60 pounds per square inch. Initially, a booster signal 100 of approximately 40 volts is provided in order to accelerate generation of the electromagnetic field by windings 41 of coil 40. This type of signal is normally provided in prior art airless solenoid-operated applicators, but a comparatively longer time for this booster signal is required due to the length of the coils used (approximately 4.2 milliseconds versus 2.25 milliseconds as in the present invention).

Thereafter, the voltage signal is reduced to a hold-in voltage 101, whereby maintenance of the electromagnetic field is provided during such signal so that adhesive is allowed to be applied to a product (i.e., plunger assembly 16 moves from the closed position to the open position, which takes approximately 0.5 milliseconds). The time in which this hold-in voltage is applied depends upon how long a pattern is required, but the voltage level required in the present invention is substantially less than in the prior art (11 volts versus 20 volts). As previously noted, the duration of hold-in signal 101 can also be compensated for by an encoder, which signals the controller regarding changes in product speed.

Shaded area 102 of FIG. 6 represents the time that mechanical response of the applicator occurs (i.e., fluid is dispensed by the applicator and applied to the product). At some point 103, the signal from the controller will be turned off, whereby plunger assembly 16, through tapered needle end 27, will restrict adhesive flow through seat 34 within a certain response time. Once again, the applicator in the present invention reduces the time required for this closing action to occur, which may be as little as 0.5 milliseconds. This is a substantial improvement over the prior art (which requires at least 6 milliseconds) since such near-instantaneous closure of the applicator allows shorter and results in far more accurate patterns.

Finally, once the signal from the controller is turned off, the electromagnetic field generated by coil 40 reverses direction due to hysteresis effects (as seen by a negative value for the signal in FIG. 6), thereby causing initialization of decay of the electromagnetic field. Accordingly, it is imperative that the electronic components in the controller be rated in terms of current, voltage, and wattage so as to withstand this hysteresis effect.

Another advantage of utilizing a coil having windings with a length comparatively shorter than in the prior art is that coil 40 has a faster rate of decay for its electromagnetic field, which is indicated by line 104. This enables the applicator to repeat the cycle much more quickly. For example, the rate of electromagnetic decay for the applicator of the present invention allows total collapse thereof in approximately 4 milliseconds, as opposed to 15 milliseconds for applicators in the prior art. This obviously provides a substantial advantage in the form of enhanced production.

It should be understood that fluids having a high viscosity, as with the adhesive described in conjunction with the fluid flow in the preferred embodiment of the present invention, will have a slower rate of flow than other less viscous adhesives and fluids, and response times for the applicator in this invention may vary depending upon the use of such other adhesives or fluids and the pressure under which such fluids are placed. However, the response times of the applicator in the present invention will nevertheless be comparatively quicker than airless, solenoid-operated applicators of the prior art for such fluids.

Although the preferred embodiment has been described with respect to cold adhesive applications, it will be understood by those skilled in the art that the applicator of the present invention may be modified to perform hot melt adhesive applications by merely connecting a heating cartridge and thermostat to connector 45 within housing base 7.

Figure 7:
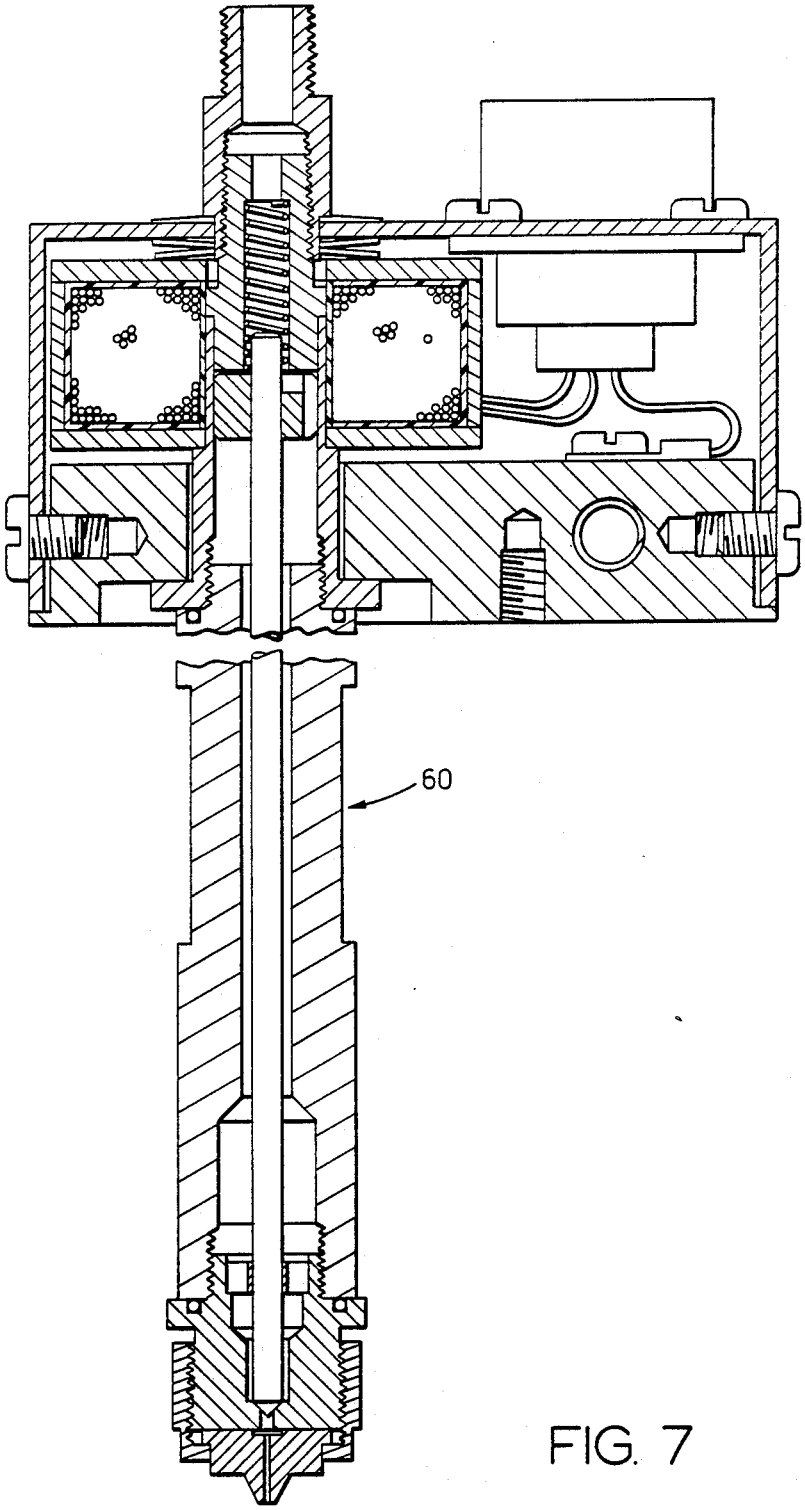
FIG. 7 is a fragmentary cross-sectional side view of an applicator similar to that of FIG. 1 with an extended fluid body.

An alternate embodiment of the applicator of the present invention involves having an extended fluid body assembly 60, which is depicted in FIG. 7. Other than extended fluid body assembly 60, all other parts and elements of the applicator depicted therein are the same as that in FIG. 1. This embodiment of the invention particularly allows greater flexibility in positioning the applicator brought about by space limitations.

Figure 8:
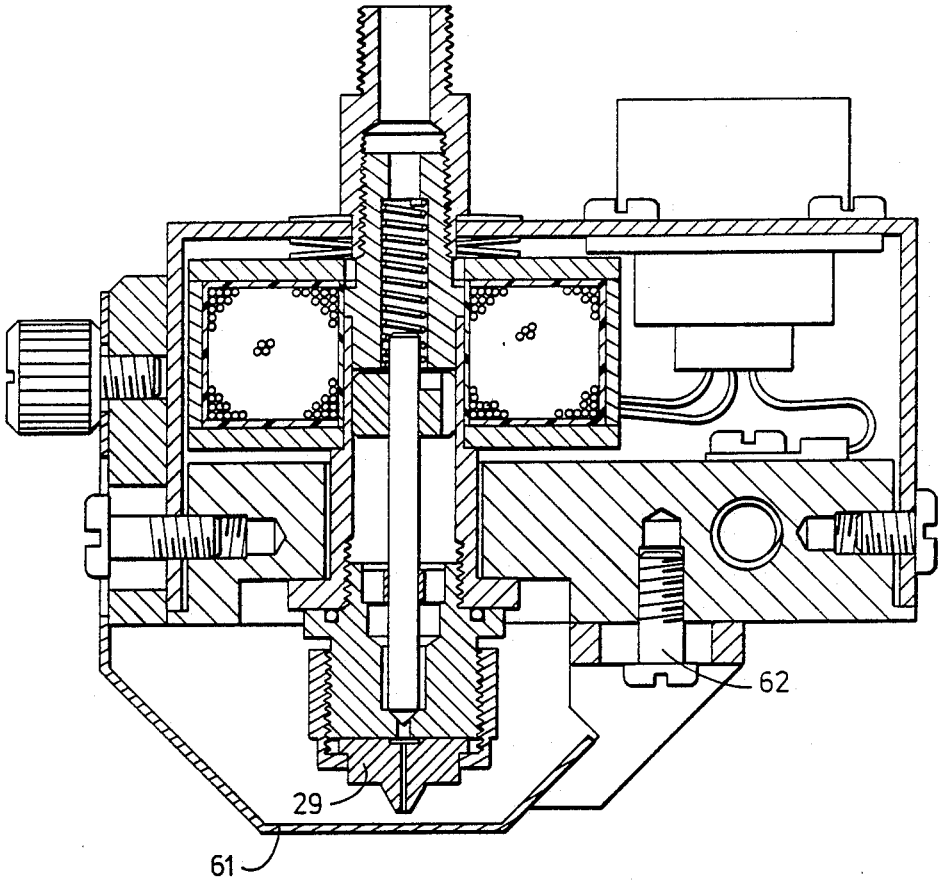
FIG. 8 is a cross-sectional side view of the applicator in FIG. 1 with a nozzle guard.

Another embodiment for applicator 1 of the present invention provides a nozzle guard 61 as seen in FIG. 8. Nozzle guard 61 extends from and is attached to housing base 7 by screws 62 for the purpose of providing protection to outlet nozzle 29 in the event a product passing thereunder comes within a predetermined distance thereof. Nozzle guard 61 is generally flexible to withstand an impact, but will not interfere with outlet nozzle 29.

While the invention has been described, disclosed, illustrated and shown in certain terms or certain embodiments or modifications which it has assumed in practice, the scope of the invention is not intended to be, nor should it be deemed to be limited thereby and such other modifications or embodiments as may be suggested by the teachings herein are particularly reserved, especially as they fall within the breadth and scope of the claims here appended.

We claim as our invention:

1. An apparatus for applying fluid to a product, comprising:

(A) a housing base;

(B) a high speed non-contact extrusion valve positioned within said housing base for allowing fluid flow therethrough, said valve further comprising:

(1) an inlet;

(2) a generally cylindrical fluid body defining a chamber therein;

(3) a static pole positioned between and secured to both said inlet and said fluid body, said static pole having a hole therethrough which is aligned with said inlet to permit fluid flow;

(4) a plunger assembly adjacent said static pole and slidably retained within said fluid body chamber, said plunger assembly including:

(a) a dynamic pole, said dynamic pole having slots formed in the top and sides thereof to permit fluid flow; and (b) a needle connected to said dynamic pole;

(5) a spring positioned within the hole in said static pole and braced against an annular flange therein, said spring also being in contact with said plunger assembly such that said plunger assembly is biased away from said static pole;

(6) an outlet connected to said fluid body; wherein said plunger assembly is positioned such that said needle abuts said outlet to interrupt fluid flow; and (7) a coil for generating an electromagnetic field on said static pole and said dynamic pole, wherein said electromagnetic field causes the plunger assembly to move toward said static pole by overcoming the bias of said spring and said needle is moved away from said outlet to allow fluid flow therethrough and application of fluid to a product; and (C) means for transmitting current to said coil.

2. The apparatus of claim 1, wherein first and second flux washers and a flux ring encompass the top, bottom and side of said windings to form an iron clad solenoid, whereby any external electromagnetic field generated by said windings is redirected so as to be concentrated on said static and dynamic poles.

3. The apparatus of claim 1, said valve further including means for guiding said needle into said outlet, said guiding means including longitudinal slots therein to permit fluid flow.

4. The apparatus of claim 1, said needle extending through said dynamic pole so that said spring fits therearound.

5. The apparatus of claim 1, said outlet further comprising:

(A) a needle seat adapter having progressively narrower openings culminating in a seat; and (B) an outlet nozzle connected to said needle seat adapter adjacent said seat.

6. The apparatus of claim 1, further including a guard connected to said housing base to protect said outlet.

7. The apparatus of claim 1, further including a housing cover connected to said housing base to protect the apparatus from the environment.

8. The apparatus of claim 1, said plunger assembly returning to the initial position wherein said needle abuts said opening when the electromagnetic field is collapsed, whereby fluid flow is again interrupted.

9. The apparatus of claim 1, said coil having windings with a length substantially equal to the distance between the inner and outer diameter of said windings.

10. The apparatus of claim 9, wherein the length of said dynamic pole is approximately one-half the length of said windings.

11. The apparatus of claim 1, wherein the static pole and dynamic pole are made from magnetically soft material.

12. The apparatus of claim 11, wherein the static pole and dynamic pole are made from low carbon steel.

13. The apparatus of claim 11, said static pole and said dynamic pole being subjected to an annealing process, wherein the grain structure of the material is aligned and impurities from the material are reduced, whereby susceptibility of said static pole and said dynamic pole to magnetism is enhanced.

14. The apparatus of claim 11, wherein the static pole and dynamic pole are coated with a solution which is magnetically conductive and corrosion resistant.

15. The apparatus of claim 11, wherein the static pole and dynamic pole are plated with a material which is magnetically conductive and corrosion resistant.

16. An apparatus for applying fluid to a product, comprising:

(A) a housing base;

(B) a high speed non-contact extrusion valve positioned within said housing base for allowing fluid flow therethrough, said valve further comprising:

(1) an inlet;

(2) a generally cylindrical fluid body defining a chamber therein;

(3) a static pole made from magnetically soft material positioned between and secured to both said inlet and said fluid body, said static pole having a hole therethrough which is aligned with said inlet to permit fluid flow;

(4) a plunger assembly adjacent said static pole and slidably retained within said fluid body chamber, said plunger assembly including:

(a) a dynamic pole made from magnetically soft material, said dynamic pole having slots formed in the top and sides thereof to permit fluid flow, wherein said top slots increase the surface area of said dynamic pole; and (b) a needle connected to and extending into said dynamic pole;

(5) a spring positioned within the hole in said static pole and braced at one end against an annular flange therein, said spring also being in contact with said plunger assembly at the other end such that said plunger assembly is biased away from said static pole;

(6) an outlet connected to said fluid body, said outlet further comprising:

(a) a needle seat adapter with progressively narrower openings culminating in a seat; and (b) an outlet nozzle connected to said needle seat adapter adjacent said seat, wherein said plunger assembly is positioned such that said needle abuts said seat to interrupt fluid flow; and (7) a coil for generating an electromagnetic field on said static pole and said dynamic pole, said coil further comprising:

(i) windings having a length substantially equal to the distance between its inner and outer diameter; and (ii) an iron clad solenoid including first and second flux washers encompassing the top and bottom of said windings and a flux ring encompassing the side of said windings, wherein said electromagnetic field causes the plunger assembly to move toward said static pole by overcoming the bias of said spring and said needle is moved away from said seat to allow fluid flow therethrough and application of fluid to a product.

17. The apparatus of claim 16, wherein the length of said dynamic pole is approximately one-half the length of said windings.

18. The apparatus of claim 16, wherein the static pole and dynamic pole are made from low carbon steel.

19. The apparatus of claim 16, said static pole and said dynamic pole being subjected to an annealing process, wherein the grain structure of the material is aligned and impurities from the material are reduced, whereby the susceptibility of said static pole and said dynamic pole to magnetism is enhanced.

20. The apparatus of claim 16, wherein the static pole and dynamic pole are coated with a solution which is magnetically conductive and corrosion resistant.

21. The apparatus of claim 16, wherein the static pole and dynamic pole are plated with a material which is magnetically conductive and corrosion resistant.

22. The applicator of claim 16, said valve further including means for guiding said needle into said outlet, said guiding means including longitudinal slots therein to permit fluid flow.

23. The apparatus of claim 16, said spring fitting around the top of said needle extending through said dynamic pole.

24. The apparatus of claim 16, further including a guard connected to said housing base to protect said outlet nozzle.

25. The apparatus of claim 16, further including a housing cover connected to said housing base to protect the apparatus from the environment.

26. The apparatus of claim 16, said plunger assembly returning to the initial position wherein said needle abuts said seat when the electromagnetic field is collapsed, whereby fluid flow is again interrupted.

* * * * *